US012774594B2

(12) United States Patent
Ritter et al.

(10) Patent No.: US 12,774,594 B2
(45) Date of Patent: Oct. 27, 2026

(54) SYSTEMS AND METHODS OF FILLING AND DRAINING PLUMBING FIXTURES

(71) Applicant: Kohler Co., Kohler, WI (US)

(72) Inventors: David Ritter, Kohler, WI (US); Brian Core, Fond du Lac, WI (US); Jesse Miller, Fond du Lac, WI (US); Douglas J. Brouwer, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 261 days.

(21) Appl. No.: 18/612,052

(22) Filed: Mar. 21, 2024

(65) Prior Publication Data

US 2024/0318414 A1 Sep. 26, 2024

Related U.S. Application Data

(60) Provisional application No. 63/491,886, filed on Mar. 23, 2023.

(51) Int. Cl.

| | |
|---|---|
| ***E03C 1/242*** | (2006.01) |
| ***E03C 1/16*** | (2006.01) |
| ***E03C 1/232*** | (2006.01) |
| ***E03D 9/08*** | (2006.01) |
| *A47K 3/02* | (2006.01) |

(52) U.S. Cl.

CPC ..... *E03C 1/242* (2013.01); *E03C 1/16* (2013.01); *E03C 1/232* (2013.01); *E03D 9/08* (2013.01); *A47K 3/02* (2013.01)

(58) Field of Classification Search

CPC ..... E03C 1/242; E03D 1/34
USPC ..... 4/427
See application file for complete search history.

(56) References Cited

U.S. PATENT DOCUMENTS

| | | | |
|---|---|---|---|
| 1,704,510 | A | 3/1929 | Muend |
| 1,737,804 | A | 12/1929 | Reedy |
| 1,781,325 | A | 11/1930 | Dowling |

(Continued)

FOREIGN PATENT DOCUMENTS

| | | | |
|---|---|---|---|
| CN | 102230320 | A | 11/2011 |
| CN | 202173317 | U | 3/2012 |

(Continued)

OTHER PUBLICATIONS

Extended European Search Report on EP Appl. No. 20213487.0 dated May 20, 2021 (10 pages).

(Continued)

*Primary Examiner* — Lauren A Crane
(74) *Attorney, Agent, or Firm* — Foley & Lardner LLP

(57) ABSTRACT

A plumbing assembly includes a tank, a bowl in fluid communication with the tank, and a re-fill assembly fluidly coupled to the tank, the re-fill assembly having at least one re-fill assembly valve and being configured to control a flow of water from the tank to the bowl. The plumbing assembly also includes at least one controller operably coupled to the re-fill assembly, the at least one controller being configured to control the at least one valve within the re-fill assembly. The plumbing assembly further includes a first sensor communicably coupled to the at least one controller, the first sensor being configured to sense a water level within the bowl, wherein the at least one controller is configured to stop the flow of water responsive to the water level within the bowl satisfying a first threshold.

20 Claims, 9 Drawing Sheets

(56) References Cited

U.S. PATENT DOCUMENTS

| | | | | |
|---|---|---|---|---|
| 1,821,584 | A | 9/1931 | Schultis | |
| 1,943,628 | A | 1/1934 | Schultis | |
| 3,064,094 | A | 11/1962 | Marchi | |
| 3,156,931 | A | 11/1964 | Holtman | |
| 3,159,849 | A | 12/1964 | Jacuzzi | |
| 3,591,872 | A | 7/1971 | Vanegas et al. | |
| 3,860,977 | A | 1/1975 | Politz | |
| 4,468,938 | A | 9/1984 | Mcmillan | |
| 4,700,884 | A | 10/1987 | Barrett et al. | |
| 4,852,054 | A | 7/1989 | Mastandrea | |
| 4,930,164 | A | 6/1990 | Gibson | |
| 5,036,553 | A * | 8/1991 | Sanderson | E03D 5/10 4/324 |
| 5,079,784 | A | 1/1992 | Rist et al. | |
| 5,121,509 | A | 6/1992 | Juple | |
| 5,207,251 | A | 5/1993 | Cooks | |
| 5,210,886 | A | 5/1993 | Coe, III | |
| 5,333,498 | A | 8/1994 | Brackett et al. | |
| 6,058,525 | A | 5/2000 | Paden | |
| 6,142,017 | A | 11/2000 | Glassey | |
| 6,473,917 | B1 | 11/2002 | Mateina | |
| 6,497,143 | B1 | 12/2002 | Rinkewich | |
| 6,732,388 | B2 | 5/2004 | Mckenna | |
| 6,877,170 | B1 * | 4/2005 | Quintana | E03D 5/10 4/406 |
| 6,895,610 | B2 | 5/2005 | Olson | |
| 7,007,319 | B2 | 3/2006 | Dunnett et al. | |
| 7,076,814 | B2 | 7/2006 | Ostrowski et al. | |
| 7,451,502 | B2 | 11/2008 | Ball | |
| 7,631,522 | B2 | 12/2009 | Bindocci et al. | |
| 7,658,104 | B2 | 2/2010 | Hewitt | |
| 7,913,331 | B2 | 3/2011 | Hartman | |
| 8,505,139 | B2 | 8/2013 | Vanhazebrouck et al. | |
| 9,096,966 | B2 | 8/2015 | Kaltofen | |
| 9,816,258 | B2 | 11/2017 | Marotz et al. | |
| 10,760,250 | B2 | 9/2020 | Ewers | |
| 10,774,510 | B2 | 9/2020 | Braddock et al. | |
| 11,064,844 | B2 | 7/2021 | Braddock et al. | |
| 11,085,178 | B1 | 8/2021 | Oliver | |
| 11,169,548 | B2 | 11/2021 | Shaaban et al. | |
| 11,725,373 | B2 | 8/2023 | Ritter et al. | |
| 2005/0028295 | A1 | 2/2005 | Jeon et al. | |
| 2008/0047060 | A1 | 2/2008 | Ball | |
| 2008/0163416 | A1 | 7/2008 | Go | |
| 2009/0050209 | A1 | 2/2009 | Rautavuori | |
| 2009/0178192 | A1 | 7/2009 | Vassilev | |
| 2013/0175350 | A1 | 7/2013 | Marks | |
| 2014/0174547 | A1 | 6/2014 | Joo | |
| 2014/0359935 | A1 | 12/2014 | Veros et al. | |
| 2015/0122337 | A1 | 5/2015 | Manavoglu et al. | |
| 2015/0227145 | A1 | 8/2015 | Reddy et al. | |
| 2015/0240464 | A1 | 8/2015 | Meyers | |
| 2016/0177554 | A1 | 6/2016 | Yu | |
| 2016/0186418 | A1 | 6/2016 | Yu | |
| 2017/0342629 | A1 | 11/2017 | Gwon et al. | |
| 2018/0310775 | A1 | 11/2018 | Degraye et al. | |
| 2018/0364743 | A1 | 12/2018 | Limberg et al. | |
| 2019/0331252 | A1 | 10/2019 | Jensen et al. | |
| 2019/0368180 | A1 * | 12/2019 | Yaoka | A61L 2/10 |
| 2020/0033898 | A1 | 1/2020 | Shaaban et al. | |
| 2021/0180304 | A1 | 6/2021 | Ritter et al. | |
| 2021/0207352 | A1 * | 7/2021 | Kim | E03D 5/022 |
| 2021/0270025 | A1 * | 9/2021 | Hayashi | E03D 5/105 |

FOREIGN PATENT DOCUMENTS

| | | | |
|---|---|---|---|
| CN | 206037430 | U | 3/2017 |
| CN | 106802176 | A | 6/2017 |
| DE | 39 25 590 | A1 | 2/1991 |
| EP | 0 174 53 | A1 | 3/1980 |
| EP | 2 918 739 | A1 | 9/2015 |
| FR | 2704882 | | 11/1994 |

OTHER PUBLICATIONS

Final Office Action on U.S. Appl. No. 17/117,325 DTD Jul. 12, 2022.

First Chinese Office Action for CN Appl. Ser. No. 201910654352.1 dated Aug. 17, 2020 (18 pages) (English Translation).

First Chinese Office Action on CN Appl. Ser. No. 202011470989.4 dated Mar. 29, 2022 (20 pages).

Machine English Translation of DE3925590A1 (2021).

Non-Final Office Action on U.S. Appl. No. 17/117,325 DTD Dec. 6, 2022.

Non-Final Office Action on U.S. Appl. No. 17/117,325 dated Feb. 2, 2022 (12 pages).

Notice of Allowance on U.S. Appl. No. 17/117,325 DTD Mar. 30, 2023.

Salesa, Yuyan, "What is the name of the unit that controls the flow and temperature of the bathtub?", Askinglot.com, 2020, Retrieved from https://askinglot.com/what-is-the-name-of-the-unit-that-controls-the-flow-and-temperature-of-the-bathtub on Jan. 4, 2022 (3 pages).

Second Chinese Office Action issued in connection with CN Appl. Ser. No. 202011470989.4 dated Sep. 28, 2022 (10 pages).

Second Office Action issued in connection with CN Appl. No. 201910654352.1 dated Jun. 3, 2021 (18 pages).

* cited by examiner

SYSTEMS AND METHODS OF FILLING AND DRAINING PLUMBING FIXTURES

CROSS-REFERENCE TO RELATED APPLICATIONS

This application claims priority to U.S. Provisional Patent Application No. 63/491,886, filed Mar. 23, 2023, the entirety of which is herein incorporated by reference.

BACKGROUND

The present disclosure relates generally to systems used in a bathroom environment to improve a user's bathing and toileting experiences. More specifically, the present disclosure relates to controlling water flow though exit and overflow conduits.

Bathtub fill and drain features are often asynchronous, requiring separate operation of fill and drain features. Similarly, toilet fill and drain features are typically preset, having a fill volume that is independent of the toilet bowl volume and is prone to overflow.

Accordingly, it would be advantageous to provide a versatile fill and drainage system for bathroom plumbing fixtures (e.g., bathtub, toilet) that can coordinate, control, and monitor filling and drainage to ensure a best possible experience by a user.

SUMMARY

One aspect of the present disclosure relates to a plumbing assembly. The plumbing assembly includes a tank and a bowl in fluid communication with the tank. The plumbing assembly further includes a re-fill assembly fluidly coupled to the tank, the re-fill assembly having at least one re-fill assembly valve and being configured to control a flow of water from the tank to the bowl. The plumbing assembly also includes at least one controller operably coupled to the re-fill assembly, where the at least one controller is configured to control the at least one re-fill assembly valve within the re-fill assembly. The plumbing assembly also includes a first sensor communicably coupled to the at least one controller, where the first sensor is configured to sense a water level within the bowl, and wherein the at least one controller is configured to stop the flow of water responsive to the water level within the bowl satisfying a first threshold.

In various embodiments, the plumbing assembly includes a lid and seat assembly coupled to the bowl. In some embodiments, the lid and seat assembly include the at least one controller. In other embodiments, the lid and seat assembly includes a bidet. In yet other embodiments, the re-fill assembly is configured to operate according to a first mode and a second mode, where the first mode corresponds to a first volume of water and the second mode corresponds to a second volume of water. In various embodiments, the second volume of water is less than the first volume of water. In some embodiments, the plumbing assembly also includes a second sensor disposed within the tank, where the second sensor is communicably coupled to the at least one controller and configured to sense a water level within the tank. In other embodiments, the at least one controller is configured to determine a leak condition of the tank responsive to the water level within the tank satisfying a second threshold. In yet other embodiments, the at least one controller is configured to determine a leak condition of the tank responsive to a decrease in the water level within the tank over a predetermined period of time. In various embodiments, the at least one controller is configured to control the at least one valve within the re-fill assembly by adjusting a size of an orifice within the at least one re-fill assembly valve to control the flow of the water from the tank to the bowl. In some embodiments, the tank includes a reservoir, the reservoir being structured to receive water from a water supply. In other embodiments, the bowl includes a ridge formed within a wall surrounding the bowl, and wherein the first sensor is structured to have shape that is complementary to a shape of the ridge.

Another aspect of the present disclosure relates to a method for controlling a water level within a plumbing assembly. The method includes controlling, by a re-fill assembly, a flow of water from a tank to a bowl, where the re-fill assembly is coupled to the tank and the bowl is in fluid communication with the tank. The method also includes controlling, by at least one controller operably coupled to the re-fill assembly, at least one valve within the re-fill assembly. The method further includes sensing, by a first sensor communicably coupled to the at least one controller, a water level within the bowl. The method includes determining, by the at least one controller, the water level within the bowl satisfies a first threshold. The method further includes stopping, by the at least one controller, the flow of water to the bowl.

In various implementations, determining the water level within the bowl satisfies a first threshold includes determining the water level exceeds the first threshold. In some implementations, determining the water level within the bowl satisfies a first threshold includes determining the water level is increasing over a predetermined period of time. In other implementations, controlling the at least one valve within the re-fill assembly includes adjusting a size of an orifice within the at least one valve. In yet other implementations, controlling the at least one valve within the re-fill assembly includes sending a signal to a solenoid, where the solenoid is operably coupled to the at least one valve, to cause a change in operating status of the at least one valve. In various implementations, the method also includes filling, by a filling assembly in fluid communication with each of the tank, the bowl, and the re-fill assembly, the tank with water from a water supply. In some implementations, the method also includes sensing, by a second sensor in communication with the at least one controller, a water level within the tank. In other implementations, the method also includes determining, by the at least one controller, a leak condition of the tank responsive to a determination that the water level within the tank satisfies a second threshold.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
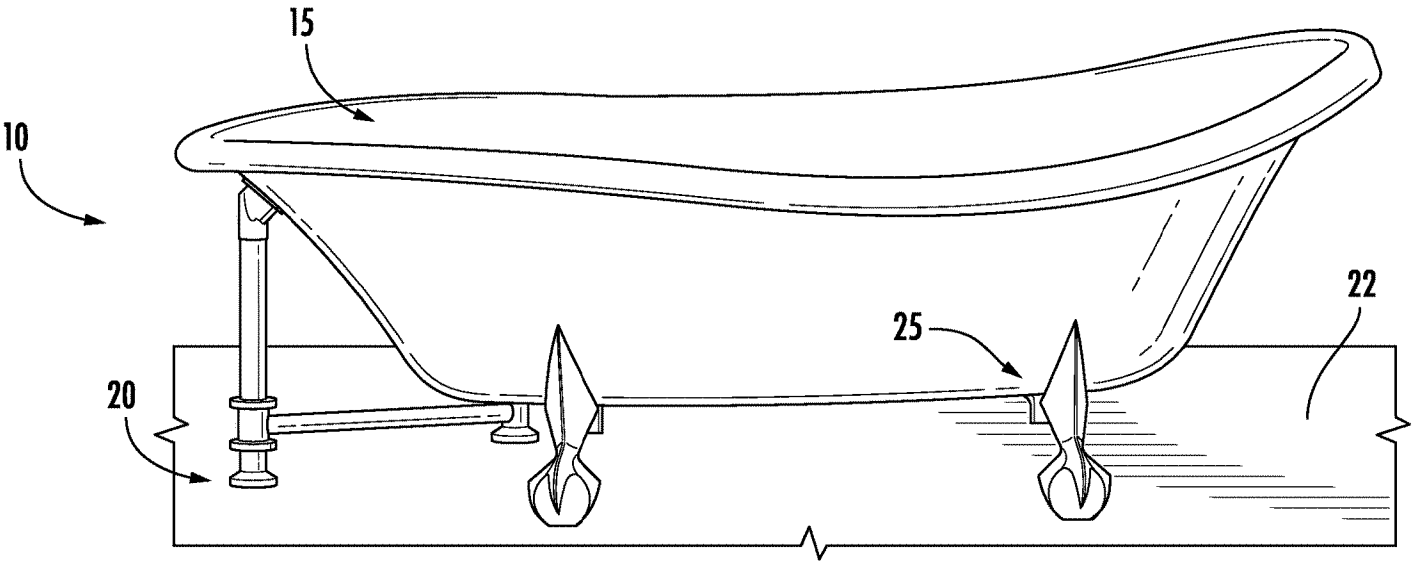
FIG. 1 is a side view of a bathtub having an above-floor drain assembly, according to an exemplary embodiment.

Referring to FIG. 1, a plumbing assembly 10 is shown, according to an exemplary embodiment. The plumbing assembly 10 includes a plumbing fixture 15 ("bathtub"), which is structured to be supported by one or more support structures 25 (e.g., claw feet, posts, etc.) a distance from a support surface (e.g., ground, floor) 22. The bathtub 15 includes a drainage assembly 20 that facilitates flow of water out of the bathtub 15. As shown, the drainage assembly 20 is structured such that water flow conduits within the drainage assembly 20 are disposed above the support surface 22—exposed and readily visible. While such a configuration may be advantageous in various use applications, having the drainage assembly 20 exposed and readily visible may be disfavored due to aesthetic purposes, trip hazards, and/or interference with one or more other bathroom fixtures. Accordingly, alternate plumbing assembly designs may include a drainage assembly that is disposed below the support surface 22 ("below the floor").

Figure 2:
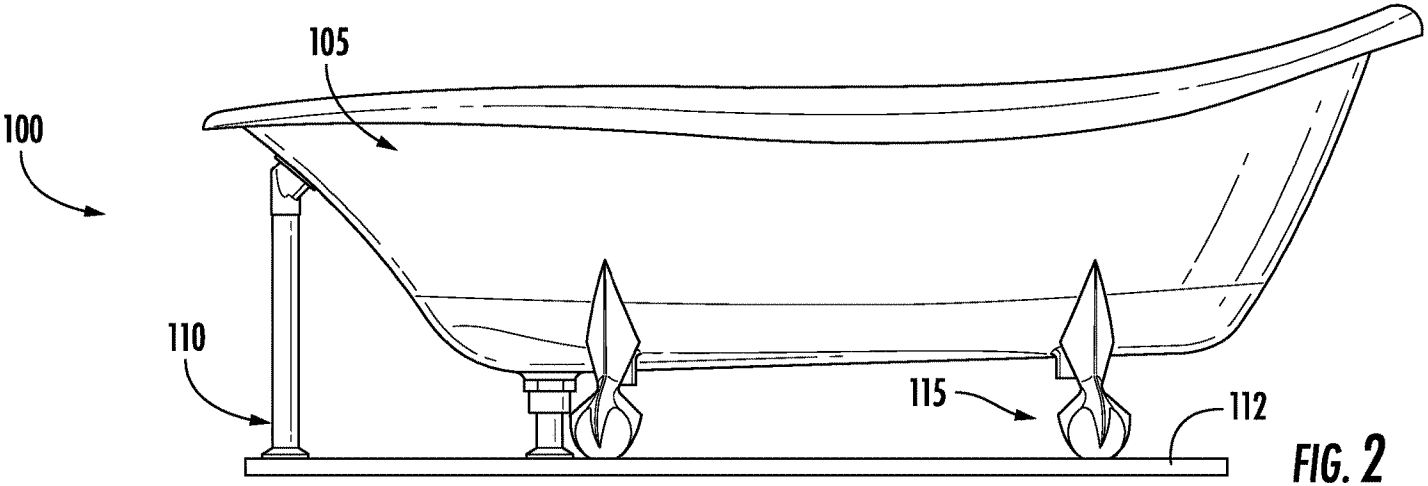
FIG. 2 is a side view of a bathtub having a below-floor drain assembly, according to an exemplary embodiment.

FIG. 2 shows a plumbing assembly 100, according to an exemplary embodiment. The plumbing assembly 100 includes a plumbing fixture 105 ("bathtub") (e.g., a claw foot bathtub), which is structured to be supported by one or more support structures 115 (e.g., claw foot, post, etc.) at a distance from a support surface 112 (e.g., ground, floor, etc.). The bathtub 105 includes a drainage assembly 110 that facilitates flow of water out of the bathtub 105. As shown, the drainage assembly 110 is structured such that at least a portion of water flow conduits within the drainage assembly 110 are disposed below the support surface 112.

Figure 3:
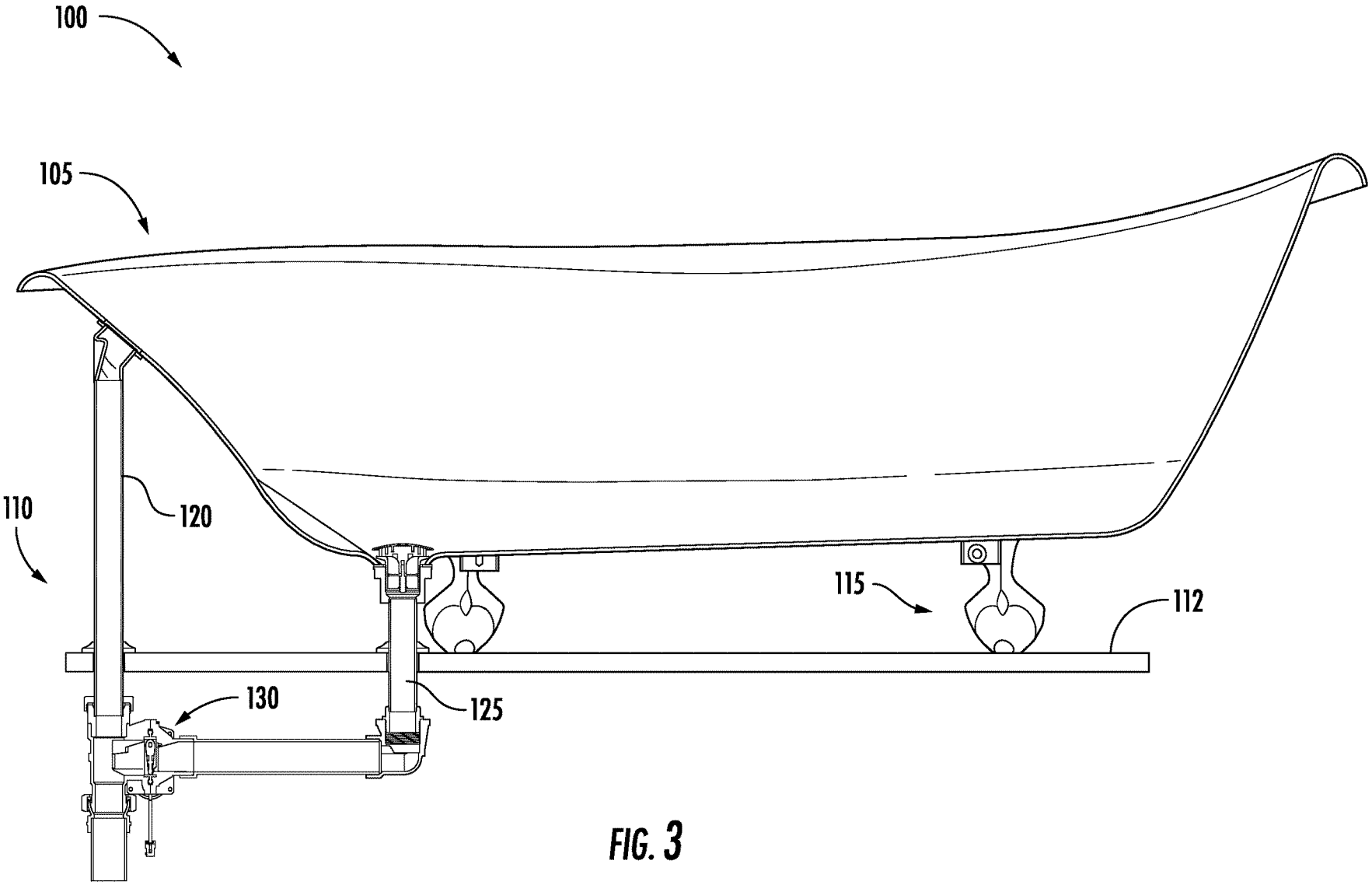
FIG. 3 is another side view of the bathtub of FIG. 2, according to an exemplary embodiment.

As shown in FIG. 3, the drainage assembly 110 includes a first conduit assembly 120 and a second conduit assembly 125, where the first conduit assembly 120 may include or be fluidly coupled to an overflow drain within the bathtub 105 and the second conduit assembly 125 may include or be fluidly coupled to a primary drain within the bathtub 105. As illustrated, both the first conduit assembly 120 and the second conduit assembly 125 are fluidly coupled at a drainage control assembly 130, which is disposed below the support surface 112. In various embodiments, at least one of the first conduit assembly 120 or the second conduit assembly 125 may include a pipe extending from the bathtub 105 to the drainage control assembly 130. In various embodiments, at least one of the first conduit assembly 120 or the second conduit assembly 125 may be metallic, such as brass. The drainage control assembly 130 is configured to control a flow of water out of the bathtub 105, such as by controlling a drainage rate through the first and/or second conduit assemblies 120, 125.

Figure 5:
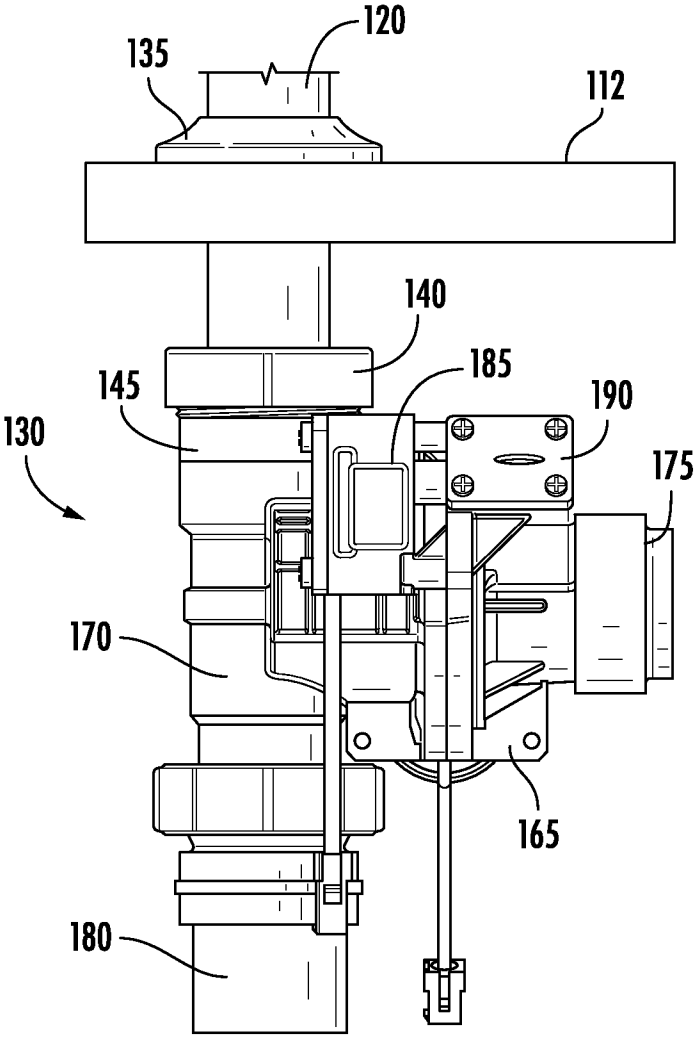
FIG. 5 is a side view of the drain control assembly of FIG. 4, according to an exemplary embodiment.
Figure 4:
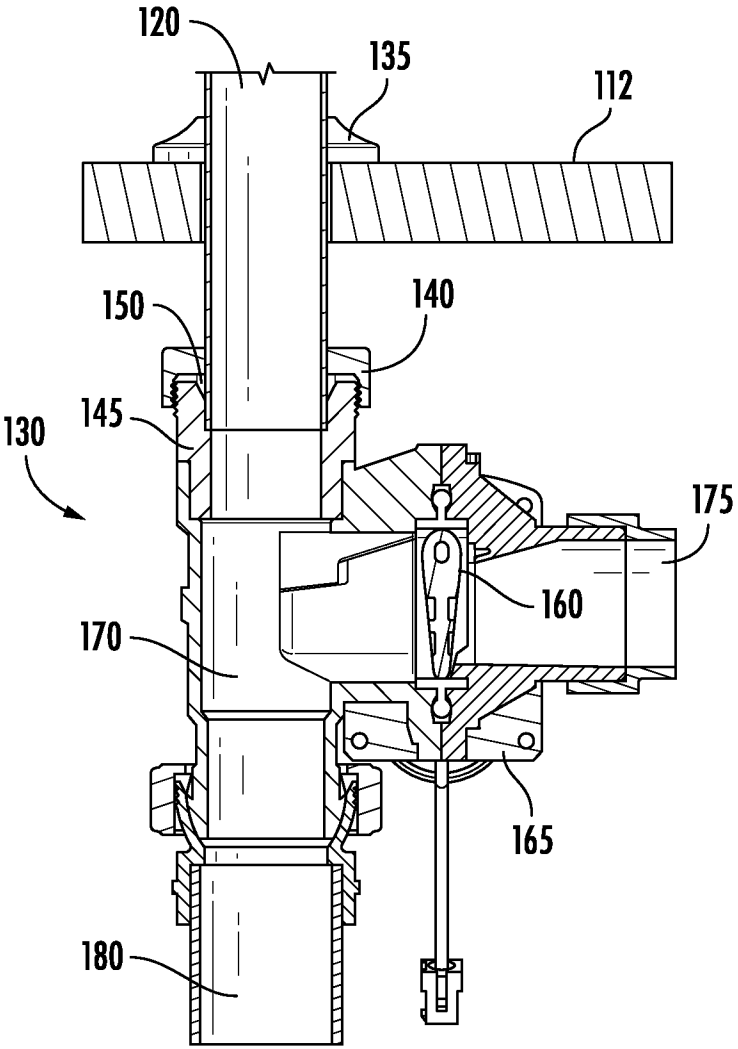
FIG. 4 is a side cross-sectional view of a drain control assembly of the bathtub of FIG. 3, according to an exemplary embodiment.

As shown in FIGS. 4 and 5, the first conduit assembly 120 extends through the support surface 112 to couple to the drainage control assembly 130. The first conduit assembly 120 includes a flange 135, which concentrically fits over a conduit (e.g., pipe) of the first conduit assembly 120. The flange 135 may be frustoconical in shape, having an upper outer diameter that is smaller than a lower outer diameter, with a tapering outer side wall that slopes from the upper diameter to the lower diameter. In various embodiments, the flange 135 may be structured as a grip flange, configured to abut the support surface 112.

FIGS. 4 and 5 also show side cross-sectional and side views, respectively, of the drainage control assembly 130, according to an exemplary embodiment. As shown, the drainage control assembly 130 is fluidly coupled to the first conduit assembly 120 via an adapter 145 and a coupler 140, which couples to the adapter 145. In various embodiments, the adapter 145 may be a polyvinyl chloride (PVC) adapter. In some embodiments, the coupler 140 may be a nut (e.g., a hex nut). In yet other embodiments, the coupler 140 may be metallic (e.g., brass). In various embodiments, a seal 150 (e.g., o-ring, gasket, washer, etc.) may be disposed between the adapter 145 and the coupler 140 to fluidly seal the connection therebetween. In various embodiments, the seal 150 may be a tapered seal, structured to have a tapered shape to accommodate a shape or contour of at least one of the adapter 145 or the coupler 140.

As shown, the drainage control assembly 130 includes a first conduit 170 and a second conduit 175, where the first conduit 170 may be a t-joint, structured to receive water flow from two directions and routing water flow through one outlet conduit 180. The first and second conduits 170, 175 may be mutually coupled to form a housing, which includes a valve 160 (e.g., paddle valve, butterfly valve, etc.), where the valve 160 is structured to control water flow through the first conduit 170 by controlling an amount of water received through the second conduit 175 (i.e., where the second conduit 175 is fluidly coupled to the second conduit assembly 125). In various embodiments, the valve 160 is operably coupled to an actuator (e.g., motor) 165, which controls actuation of the valve 160. In various embodiments, operation of the actuator 165 is responsive to a control signal received from at least one controller that is included within or is communicatively coupled to the actuator 165. In various embodiments, the controller may be a non-transitory computer readable medium or processor, having computer-readable instructions stored thereon that, when executed, cause the at least one controller to carry out operations called for by the instructions. The at least one controller may be provided with a power source, a memory, a communications interface, and a processor. In various embodiments, the at least one controller may be a computing device. In other embodiments, the at least one controller may be configured as part of a data cloud computing system configured to receive commands from a user control device and/or a remote computing device.

In various embodiments, the control signal received by the actuator 165 may be responsive to one or more sensed inputs relating to water within the bathtub 105. As shown in FIG. 5, the drainage control assembly 130 includes at least one of a temperature sensor 185 or a pressure sensor 195, which are respectively configured to measure a temperature of water flow through the drainage control assembly 130 and a water pressure within the drainage control assembly 130. The temperature sensor 185 may be a thermistor or other type of temperature sensor. The temperature sensor 185 may be communicably coupled to the at least one controller and the actuator 165 such that the actuator 165 may be configured to activate and actuate the valve 160 responsive to a temperature measurement by the temperature sensor 185 satisfying one or more predetermined temperature thresholds. For example, the actuator 165 may actuate the valve 160 responsive to the temperature sensor 185 measuring a temperature satisfying a first water temperature threshold (e.g., corresponding to a water temperature being too cold) and/or a second water temperature threshold (e.g., corresponding to water temperature being too hot). In various embodiments, the one or more temperature thresholds may be set by a user of the bathtub 105 and/or a manufacturer of the plumbing assembly 100 (e.g., such as via a user device, remote computing system, and/or a control unit coupled to or in connection with the assembly 100).

The pressure sensor 190 may be a strain gauge, piezoelectric sensor, capacitive sensor, manometer, vacuum pressure sensor, or other type of pressure sensor. The pressure sensor 190 may be communicably coupled to the at least one controller and the actuator 165 such that the actuator 165 may be configured to activate and actuate the valve 160 responsive to a pressure measurement by the pressure sensor 190 satisfying one or more predetermined pressure thresholds. For example, the actuator 165 may cause the valve 160 to open responsive to the pressure sensor 190 measuring a pressure satisfying a first water pressure threshold (e.g., corresponding to a water pressure being too high) and/or a the actuator 165 may cause the valve 160 to close responsive to the pressure sensor 190 measuring a pressure satisfying a second water pressure threshold (e.g., corresponding to water pressure being too low). In various embodiments, the one or more pressure thresholds may be set by a user of the bathtub 105 and/or a manufacturer of the plumbing assembly 100 (e.g., such as via a user device, remote computing system, and/or a control unit coupled to or in connection with the assembly 100). In various embodiments, the pressure measured by the pressure sensor 190 may correspond to a volume of water within the bathtub 105 and the one or more pressure thresholds corresponding to one or more water volume thresholds within the bathtub 105. Accordingly, the actuator 165 may operate the valve 160 to facilitate precise filling and draining of the bathtub 105 by using water pressure as a proxy for water level.

Figure 7:
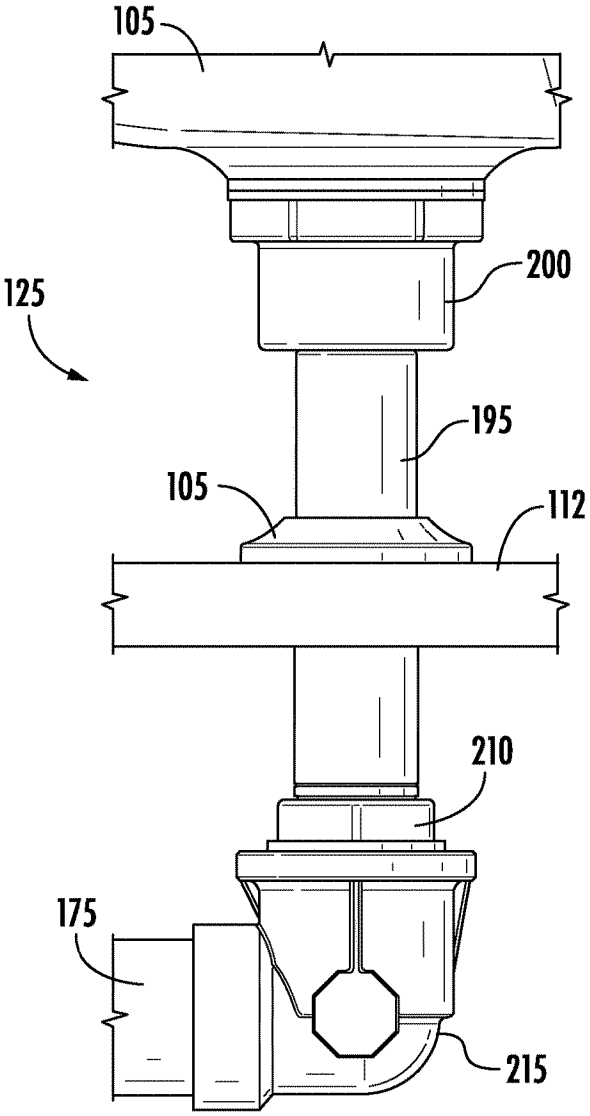
FIG. 7 is a side view of the drain assembly of FIG. 6, according to an exemplary embodiment.
Figure 6:
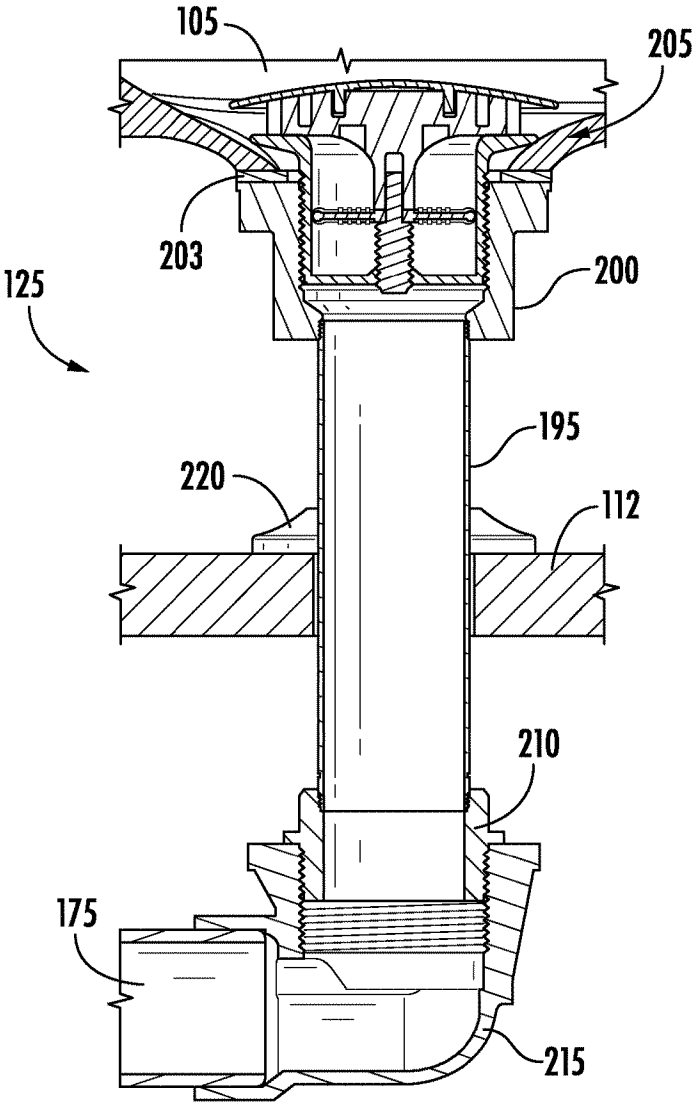
FIG. 6 is a side cross-sectional view of a drain assembly of the bathtub of FIG. 3, according to an exemplary embodiment.

FIGS. 6 and 7 show side cross-sectional and side views, respectively of the second conduit assembly 125. As illustrated, the second conduit assembly 125 includes at least one conduit 195 (e.g., pipe), which is coupled between a primary drain assembly 205 and an elbow fitting 215. In various embodiments, the elbow fitting 215 may be coupled to the conduit 195 via at least one adapter 210, which is configured to concentrically fit around the conduit 195 and within a portion of the elbow fitting 215. Accordingly, water from the bathtub 105 may flow from the bathtub 105 (i.e., as controlled by the valve 160) through the drain assembly 205, through the conduit 195, to the elbow fitting 215, and to the second conduit 175, where water is then received at the valve 160 and may exit through the outlet conduit 180 (i.e., as controlled by the valve 160).

As shown, the drain assembly 205 is disposed within a bottom portion of the bathtub 105 and is connected thereto via an adapter 200. As shown, the adapter may couple to the bathtub 105 to retain the drain assembly 205 in a position to receive water flow. In various embodiments, the adapter may be made of one or more metallic materials (e.g., brass). In some embodiments, the adapter 200 may be fluidly sealed via one or more seals 203 (e.g., gasket, o-ring, etc.). As shown, the conduit 195 extends through the support surface 112 and is supported by a flange 220, which concentrically fits over the conduit 195 (e.g., pipe). The flange 220 may be frustoconical in shape, having an upper outer diameter that is smaller than a lower outer diameter, with a tapering outer side wall that slopes from the upper diameter to the lower diameter. In various embodiments, the flange 220 may be structured as a grip flange, configured to abut the support surface 112.

Accordingly, during use of the plumbing assembly 100, the bathtub 105 (e.g., a freestanding or exposed bathtub) may be filled using a bathtub filler. The bathtub 105, as described above, is coupled to the first conduit assembly 120 and the second conduit assembly 125. A portion of each of the first and second conduit assemblies 120, 125 pass through and are disposed beneath the support surface 112 such that each of the assemblies 120, 125 are fluidly coupled to the drainage control assembly 130, which is disposed entirely beneath the support surface 112. Water from within the bathtub 105 may flow through the primary drain assembly 205 through the second conduit assembly 125, where the temperature sensor 185 and the pressure sensor 190 may determine a temperature of the water (used as a proxy for water temperature within the bathtub 105) and a pressure of the water (used as a proxy for a water level or water volume within the bathtub 105). In various embodiments, the actuator 165 may be coupled to one or more user devices and/or a control unit in communication with the bathtub filler. Accordingly, while the bathtub 105 is filling, the actuator 165 may control the valve 160 such that the valve remains closed until at least one of a threshold temperature or a threshold pressure is reached. In other embodiments, the actuator 165 may control the valve 160 such that the valve may remain open until at a threshold temperature is reached, at which point the actuator 165 may control the valve 160 to close, which would allow the bathtub 105 to fill with water at temperature that satisfies the threshold temperature. In various embodiments, once a threshold volume of water within the bathtub 105 is reached (as determined by a pressure measured by the pressure sensor 190 satisfying a predetermined pressure threshold), the actuator 165 may control the valve 160 to close. If an excess amount of water is present in the bathtub 105, or if water within the bathtub is turbulent (e.g., due to movement of a user), the excess or displaced water may flow through the overflow drain assembly and the first conduit assembly 120. Finally, water flowing through either of the first conduit assembly 120 or the second conduit assembly 125 (as controlled by the valve 160) may exit the plumbing assembly 100 through the outlet conduit 180.

In various embodiments, the plumbing assembly 100 may be integral within the bathtub 105. In other embodiments, the plumbing assembly 100 may be structured to be retrofit within the bathtub 105 (e.g., a clawfoot bathtub). In these embodiments, the plumbing assembly 100 may be installed such that components are fluidly coupled to preexisting access holes (e.g., within or through a surface or floor the bathtub 105 may be disposed on). For example, one or more components of the plumbing assembly 100, such as the flange 135, may be structured to couple (or adapted to couple to) a floor or structure to which the bathtub 105 is coupled. In other embodiments, the plumbing assembly 100 may include one or more generic components that may enable retrofitting to the bathtub 105.

Figure 8:
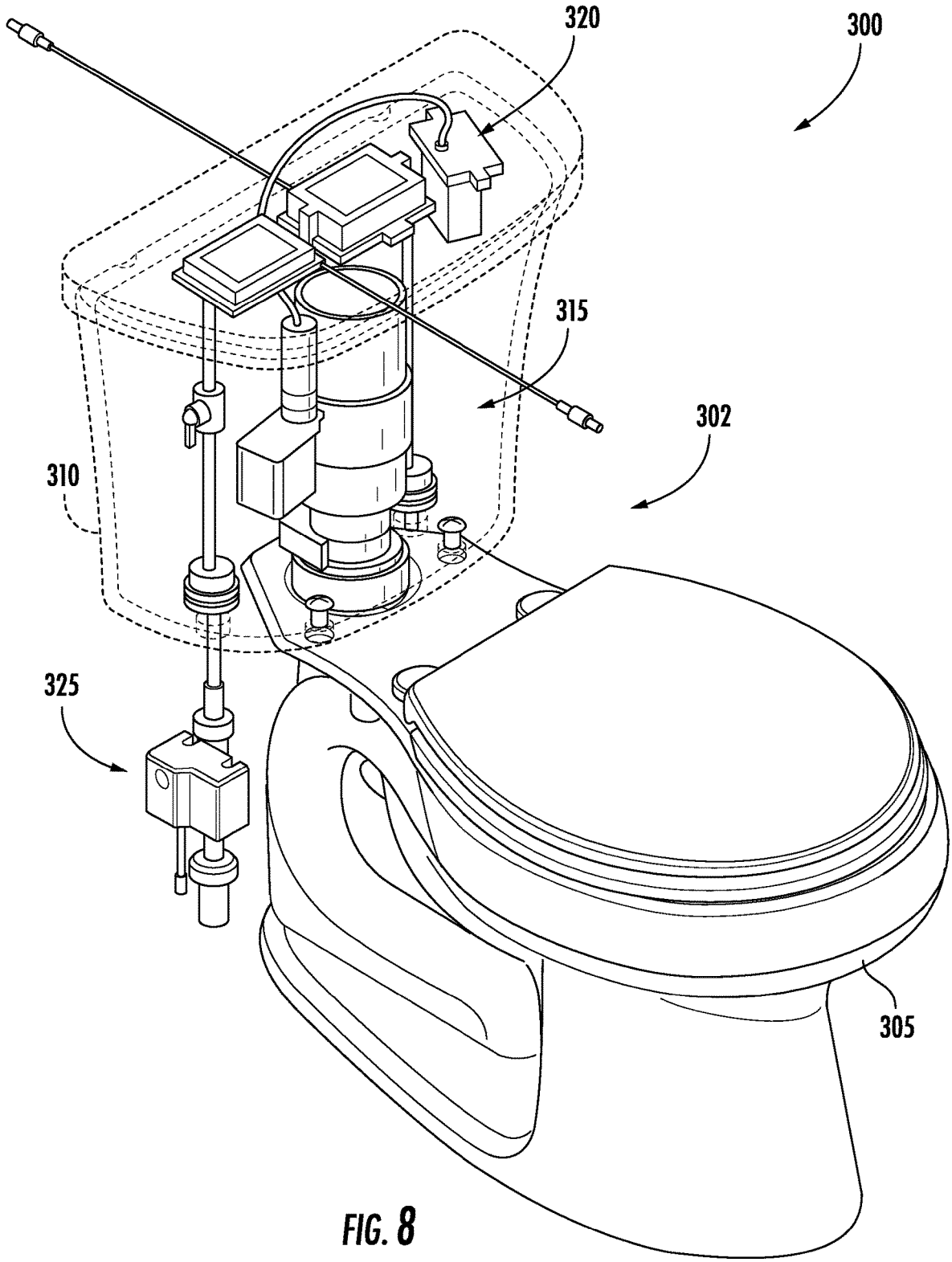
FIG. 8 is a perspective view of a toilet system, according to an exemplary embodiment.

In other implementations, plumbing fixtures besides bathtubs may be structured to include fill and drainage systems that enable precision fill volumes and automated drainage. FIG. 8 shows a plumbing assembly 300, according to an exemplary embodiment. The plumbing assembly 300 includes a toilet 302, which has a toilet bowl 305 that is fluidly coupled to and filled from a tank 310. In various embodiments, the toilet 302 may be blow molded. The tank 310 may be structured to include a flushing assembly 315, which is configured to facilitate vacating of water from within the tank 310 such that it flows into the toilet bowl 305. The flushing assembly 315 is fluidly coupled to a fill assembly 325, which facilitates flow of water (i.e., from a water supply) to the tank 310 and the flushing assembly 315. Both the flushing assembly 315 and the fill assembly 325 are operably coupled to a control assembly 320, which controls operation of each of the flushing and fill assemblies 315, 325.

Figure 9:
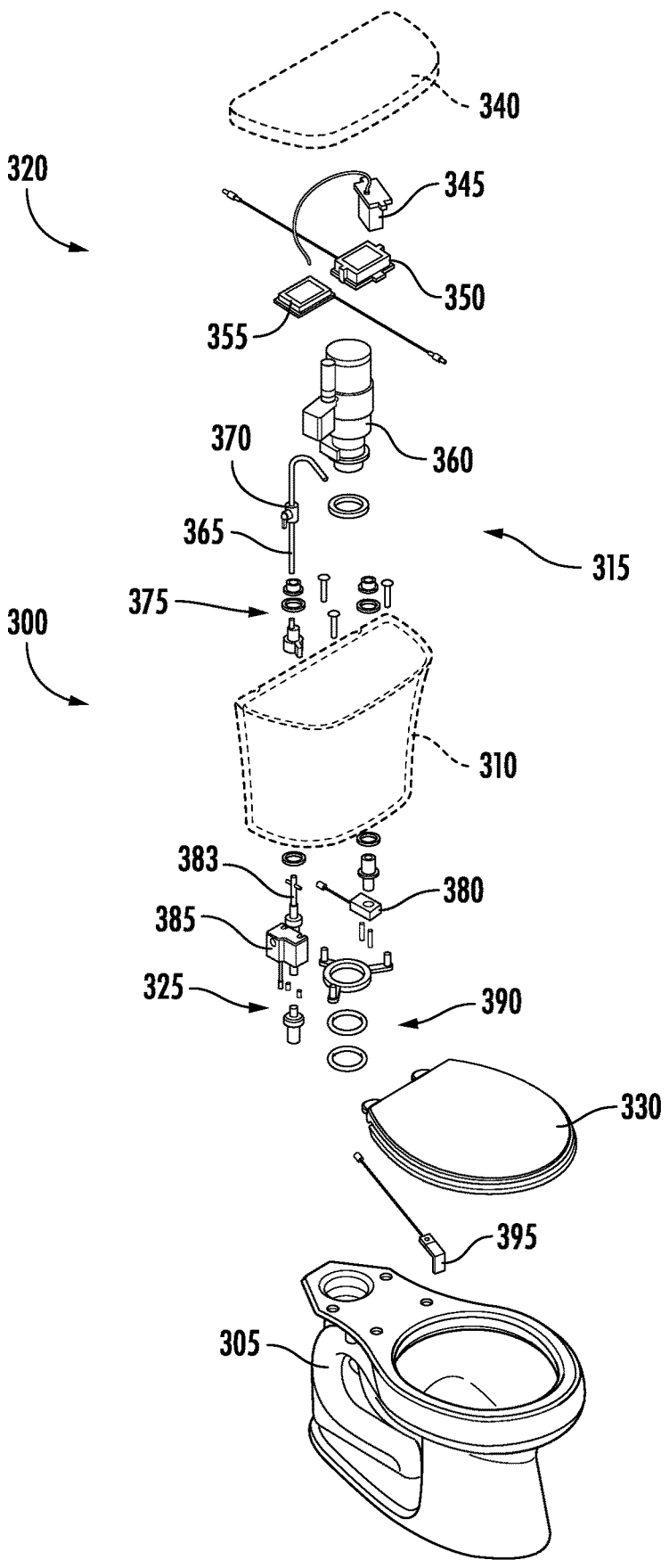
FIG. 9 is an exploded view of the toilet system of FIG. 8, according to an exemplary embodiment.

FIG. 9 shows an exploded view of the plumbing assembly 300, according to an exemplary embodiment. As shown, the control assembly 320 is housed within the tank 310 and is covered by the tank lid 340. The control assembly 320 includes at least one controller 350 that may be accessible and operable by a user of the toilet 302. The at least one controller 350 is operably coupled to and configured to control operation of components within the flushing assembly 315. In particular, the at least one controller is configured to control operation of a solenoid 345, which is operably coupled to and configured to control a dual flush valve and re-fill assembly 360. The at least one controller 350, the solenoid 345, and the dual flush valve and re-fill assembly 360 are each operably coupled to a power source 355 (e.g., battery). In various embodiments, the power source 355 may be disposed within the tank 310 or the tank lid 340.

In various embodiments, the plumbing assembly 300 may include a bidet, which may be operably coupled to the at least one controller 350. Accordingly, in some embodiments, the bidet functions may be coordinated with one or more functions of the dual flush valve and re-fill assembly 360. In various embodiments, the bidet may be configured to control one or more operations of the lid and seat assembly 330. For example, the bidet may be configured to transition (e.g., rotate, swivel, etc.) a lid of the lid and seat assembly 330 from an open to a closed position (or vice versa). In other embodiments, the bidet may switch between an active user phase and an inactive phase. When in the active user phase, the bidet may be configured to activate one or more functions of the lid and seat assembly 330 (e.g., provide heating to the seat of the lid and seat assembly 330, provide water through the bidet, etc.) and when in the inactive phase, the bidet may be powered off or otherwise be inactive (e.g., in standby mode). In various embodiments, the bidet may include or be coupled to an electronic control box, which may be configured to control operations beyond the lid and seat assembly 330. In other embodiments, the plumbing assembly 100 (via the bidet or otherwise) may be configured to operate the dual flush valve and re-fill assembly 360 in at least one or two modes. For example, in a first mode, the dual flush valve and re-fill assembly 360 may provide a first volume of water (e.g., corresponding to solids disposed within the toilet bowl 305) and, in a second mode, the dual flush valve and re-fill assembly 360 a second volume of water that is less than the first volume (e.g., corresponding to liquids disposed within the toilet bowl 305). In various embodiments, the dual flush valve and re-fill assembly 360 may be operably coupled to one or more remote devices, which may control operation of the dual flush valve and re-fill assembly 360. In other embodiments, the plumbing assembly 300 may include one or more sensors, which may be operably coupled to one or more monitoring devices (e.g., remote computing device, user device, etc.), where the monitoring devices may receive inputs (e.g., water usage, water volume, number of flushes, etc.) from the one or more sensors corresponding to operating conditions and metrics of the plumbing assembly 300.

In various embodiments, the at least one controller 350 may be a non-transitory computer readable medium or processor, having computer-readable instructions stored thereon that, when executed, cause the at least one controller 350 to carry out operations called for by the instructions. The at least one controller 350 may be provided with a power source (i.e., separate from or the same as the power source 355), a memory, a communications interface, and a processor. In various embodiments, the at least one controller 350 may be a computing device. In other embodiments, the at least one controller 350 may be configured as part of a data cloud computing system configured to receive commands from a user control device and/or a remote computing device. In various embodiments, the controller 350 may be coupled to or otherwise in communication with (e.g., via Wifi, Bluetooth, NFC, etc.) one or more remote computing devices (e.g., user device, smart home system, remote, phone, etc.), where the one or more remote computing devices is configured to send or more control signals to the controller 350 to initiate and/or terminate operation of the controller 350 and thus of the plumbing system 300.

Figure 10:
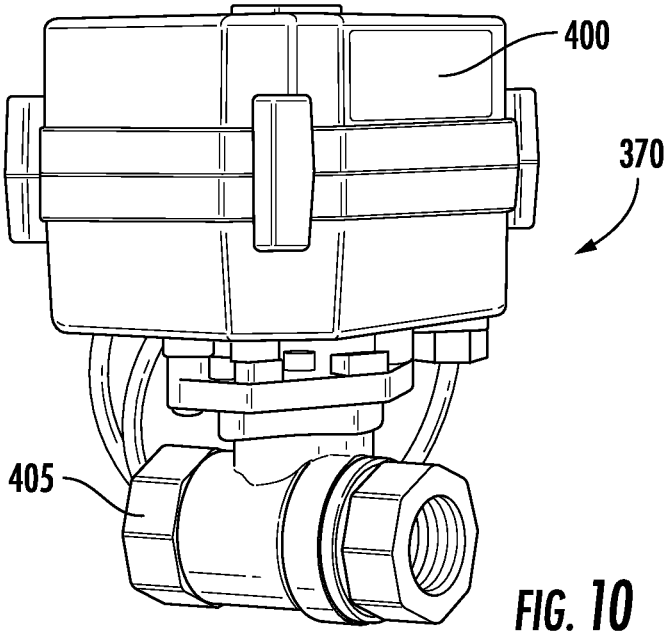
FIG. 10 is a side perspective view of a valve assembly within the toilet system of FIG. 8, according to an exemplary embodiment.

Accordingly, during operation of the plumbing system 300, the controller 350 is configured to send a signal to the solenoid 345, which then causes a change in operating status of the dual flush valve and re-fill assembly 360. In various embodiments, the change in operating status of the dual flush valve and re-fill assembly 360 includes opening or closing of a valve disposed within the assembly 360, which may allow for sequential or simultaneous expulsion of water from the tank 310 into the toilet bowl 305 and refilling of water into the tank 310 from a water supply. As shown, the flushing assembly 315 includes a conduit 365 (e.g., tube), which is fluidly coupled between the fill assembly 325 and the dual flush valve and re-fill assembly 360. As shown, the conduit 365 is fluidly coupled to a valve assembly 370, which is configured to control water flow through the conduit 365 from the fill assembly 325 to the dual flush valve and re-fill assembly 360 and the tank 310. In various embodiments, the valve assembly 370 may include at least one of a ball valve or a motorized valve. As shown in FIG. 10, the valve assembly 370 may include a motorized valve 400 and a ball valve 405. Accordingly, in some embodiments, the motorized valve 400 may be operated (e.g., by the controller 350) to cause water flow through the conduit 365 to fill the tank 310. In other embodiments, the ball valve 405 may allow water flow through the conduit 365 responsive to opening of the valve disposed within the assembly 360, which is caused by the controller 350 and solenoid 345 (i.e., during flushing of the plumbing assembly 300.

In various embodiments, the valve assembly 370 may regulate water flow (e.g., via the motorized valve 400) within the plumbing assembly 300 to provide a volume of water within the tank 310 and/or toilet bowl 305 (e.g., corresponding to a low volume or a high volume for liquids or solids, respectively) by adjusting a size of an orifice within the motorized valve 400 and ball valve 405 to adjust for a variable input of supply water pressure. In some embodiments, adjustment of the orifice size may be determined during commissioning and calibration of one or more sensors (e.g., a water level sensor) during installation of the plumbing system 300. In some embodiments, the plumbing assembly 300 may be structured to include application-specific valves. For example, in some embodiments, the dual flush valve and re-fill assembly 360 may include one or more piston valves. In other embodiments, valve assembly 370 may include one or more linear metering valves, ceramic valves (having on/off function), or any other electronically controlled valves.

As described above, the flushing assembly is contained within the tank 310, which is coupled to the bowl 305 via one or more fasteners 375. The tank 310 is fluidly sealed to the bowl 305 via one or more seals 390. The tank 310 is fluidly coupled to the fill assembly 325, which is also coupled to the flushing assembly 315. The fill assembly 325 includes an inlet conduit 383 (e.g., hose), which is fluidly coupled to a solenoid fitting (and/or valve) 385, where the solenoid fitting 385 controls water flow from a water supply through the inlet conduit 383 (i.e., which then flows to through the fill assembly 325 to the tank 310). The fill assembly 325 also includes a water level sensor 380 operably coupled to or in communication with the solenoid fitting 385, where the water level sensor 380 is configured to sense a water level within the tank 310. Finally, as shown in FIG. 9, the plumbing system 300 also includes a sensor 395 (e.g., overflow sensor), which is configured to sense a level of water/fluid within the toilet bowl 305. The sensor 395 may be in communication with the solenoid 345, where detection of an overflow condition by the sensor 395 causes the solenoid 345 to shut off (thereby ceasing filling of the toilet bowl 305). The toilet bowl 305 is also coupled to a lid and seat assembly 330, which may transition (e.g., rotate, swivel, etc.) between an open position and a closed position.

Figure 11:
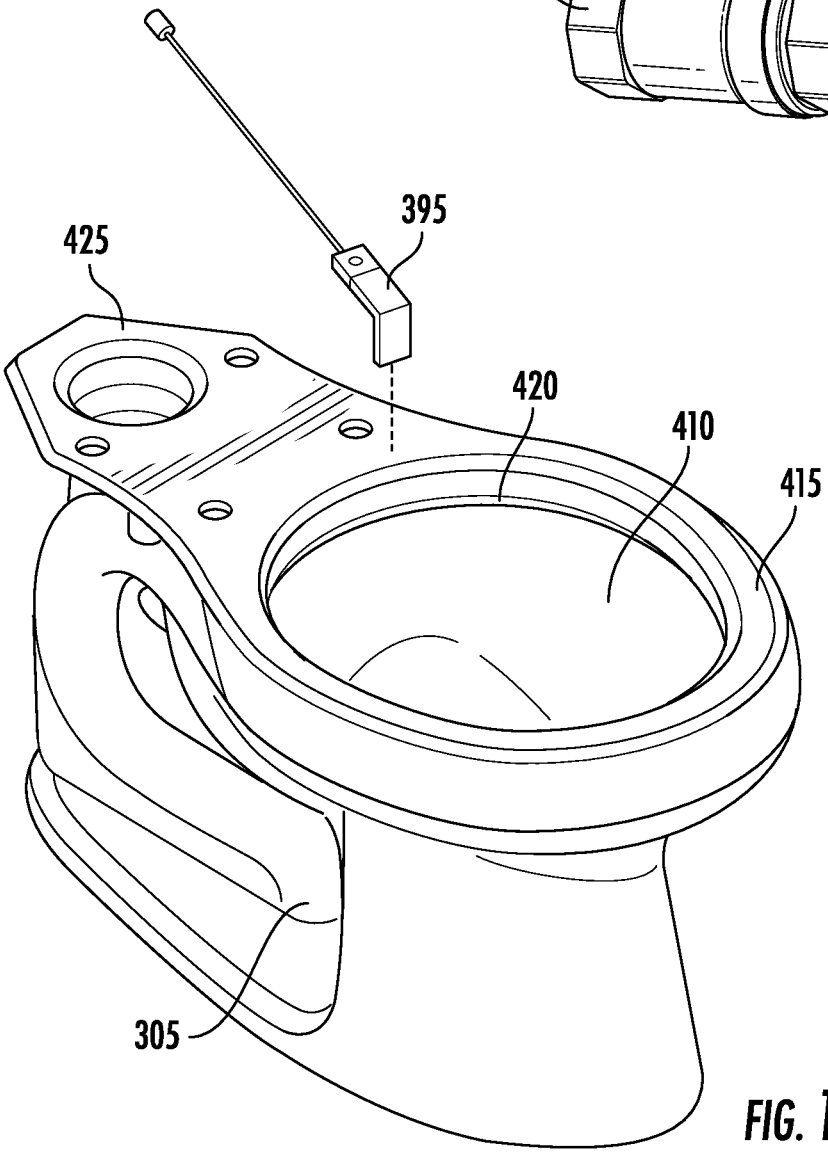
FIG. 11 is a perspective view of a toilet bowl within the toilet system of FIG. 8, according to an exemplary embodiment.

As shown in FIG. 11, the toilet bowl 305 includes a primary bowl 410 defining a volume below a ridge 420, which is formed within a wall 415 surrounding the primary bowl 410. A conduit 425, which is disposed adjacent the primary bowl 410 (e.g., to a rear of the bowl 410), is configured to fluidly couple to the tank 310 such that water from the tank 310 may flow through the conduit 425 into the bowl 410 to flush and refill the bowl 410 (i.e., responsive to a user flushing the plumbing system 300, such as via the controller 350). As shown, the sensor 395 is structured to have a complementary shape as the ridge 420 such that the sensor 395 may be positioned so as to contact water that may rise to the ridge 420 during filling or overflow (e.g., if the plumbing system 300 is clogged).

Figure 13:
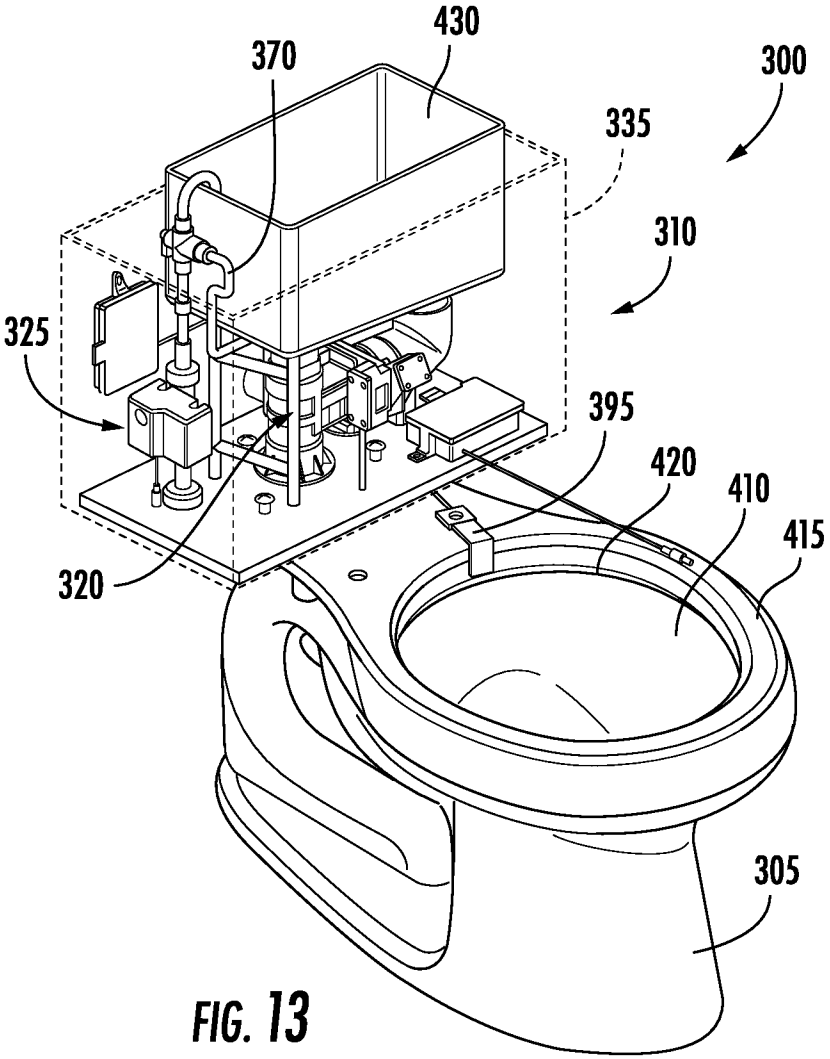
FIG. 13 is a perspective view of the toilet system of FIG. 8, according to an exemplary embodiment.
Figure 12:
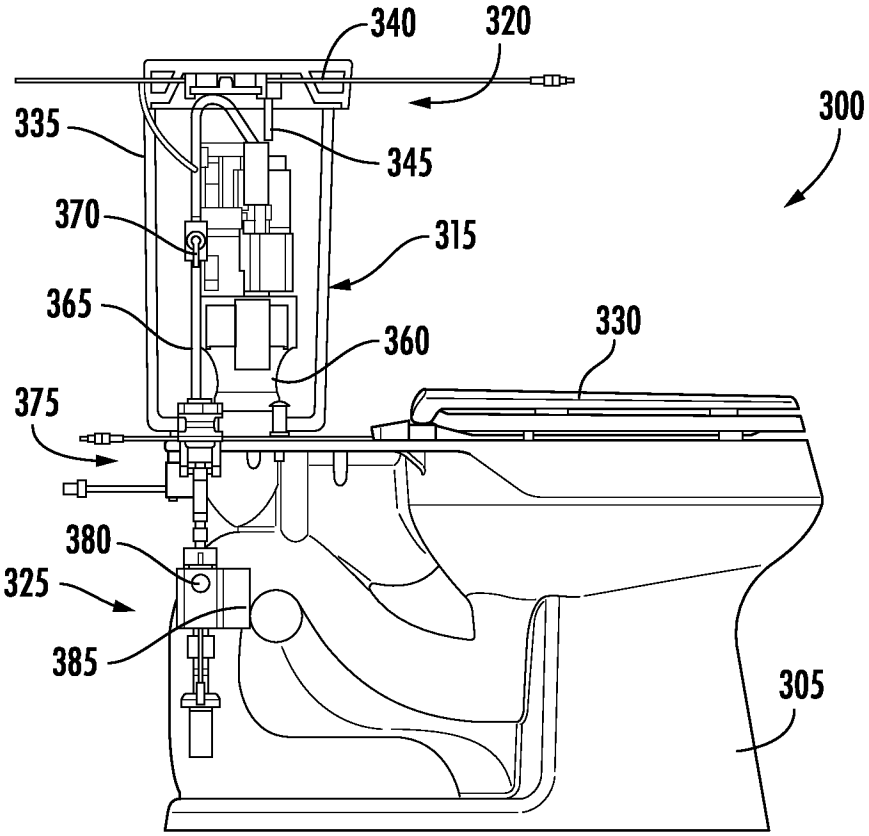
FIG. 12 is a side view of the toilet system of FIG. 8, according to an exemplary embodiment.

FIG. 12 shows a side view of the plumbing system 300, according to an exemplary embodiment. As shown, the plumbing system 300 may be structured such that the filling assembly 325 is disposed outside the tank 310 and fluidly coupled to the flushing assembly 315 and control assembly 320 contained therein. In other embodiments, such as shown in FIG. 13, the plumbing assembly 300 may be structured such that the filling assembly 325, the flushing assembly 315, and the control assembly 320 are contained within the tank 310. In such embodiments, the tank 310 may include a separate reservoir 430, which may be fluidly coupled to the filling assembly 325 and the flushing assembly 315, where water from the water supply fills the reservoir 430 and water from the reservoir 430 may be vacated into the toilet bowl 305. In various embodiments, the plumbing system 300 may be structured such that the filling assembly 325, the flushing assembly 315, and/or the control assembly 320 are installed together with the toilet 302. In other embodiments, the plumbing system 300 may be structured such that the filling assembly 325, the flushing assembly 315, and/or the control assembly 320 are retrofit to the toilet 302.

In various embodiments, the control assembly 320 may be operably coupled to one or more manual controllers (e.g., handle, button, lever, pedal, etc.), which is configured to operate the at least one controller 350 to control flushing and/or filling of the plumbing assembly 300. In other embodiments, the control assembly 320 may be communicably coupled to one or more remote computing devices (e.g., a smart home system, user device, remote, phone, etc.), which is configured to send one or more control signals to the at least one controller 350 to control flushing and/or filling of the plumbing assembly 300.

In various embodiments, the control assembly 320 may be operable provide a user with status information related to the plumbing assembly 300 and/or automatically stop flushing and/or filling of the plumbing assembly 300 responsive to detection of one or more stop conditions. In some embodiments, the controller 350 may determine a leak condition of the tank 310 based on one or more inputs received from the water level sensor 380. For example, in some embodiments, the controller 350 may receive periodic inputs from the water level sensor 380 corresponding to a water level within the tank 310. Accordingly, the controller 350 may be configured to determine there is a water leak from the tank 310 based on a determination that the water level is below a predetermined threshold and/or based on a determination that the water level is decreasing over a predetermined period of time. In response to a determination that there is a water leak from the tank 310, the controller 350 may generate an output on a coupled user interface (e.g., visual display, speaker, etc.) and/or may send a signal to a remote computing device (e.g., user device, smart home system, etc.) indicating the tank 310 has a water leak.

In various embodiments, the controller 350 may determine an overflow condition associated with the toilet bowl 305 (i.e., of the primary bowl 410) and initiate shutdown (i.e., stop a filling operation) of the plumbing system 300. In some embodiments, the controller 350 may determine the overflow condition based on one or more inputs received from the sensor 395. For example, in some embodiments, the controller 350 may receive periodic inputs from the sensor 395 corresponding to a water level within the bowl 410. Accordingly, the controller 350 may be configured to determine there is an overflow condition (i.e., the bowl 410 is over filling and is likely to overflow or is overflowing) based on a determination that the water level is at or above a predetermined threshold, an/or based on a determination that the water level is increasing over a predetermined period of time. In various embodiments, the controller 350 may receive an input from the sensor 395 that water within the bowl 410 is rising and consequently determine the bowl 410 is likely overflow. Accordingly, in various embodiments, in response to a determination that there is an overflow condition (i.e., that the bowl is overflowing or likely to overflow), the controller 350 may send a control signal to the filling assembly 325 (i.e., to the valve assembly 370 and/or or the solenoid fitting 385) to stop water flow through the conduit 383. In some embodiments, the controller 350 may additionally or alternatively generate an output on a coupled user interface (e.g., visual display, speaker, etc.) and/or may send a signal to a remote computing device (e.g., user device, smart home system, etc.) indicating the overflow condition.

In various embodiments, the controller 350 may be configured to record and store operation metrics related to the plumbing system 300. In various embodiments, the controller 350 may be configured to record and store a number of flushes, a number of fills, an amount of water used during each flush, an amount of water used for each fill, a number of detected overflow conditions, a number of detected leak conditions, and/or any other measurable metric related to the plumbing assembly 300. In some embodiments, the controller 350 may generate an output on a coupled user interface (e.g., visual display, speaker, etc.) and/or may send a signal to a remote computing device (e.g., user device, smart home system, etc.) indicating the operation metrics (or a summary thereof).

In various embodiments, the plumbing system 300 may be configured to fill the bowl 305 based on predetermined water amounts and/or predetermined flush modes. For example, in some embodiments, the controller 350 may be configured to operate in a first mode (e.g., liquid mode or light mode) and a second mode (e.g., solid mode or heavy mode). In the first mode, the controller 350 may cause the flush assembly 315 and the filling assembly 325 to operate for a first amount of time, which corresponds to a first amount of water use. In the second mode, the controller 350 may cause the flush assembly 315 and the filling assembly 325 to operate (e.g., causes the valve assembly 370 and/or dual flush valve and re-fill assembly 360 to open) for a second amount of time, which corresponds to a second amount of water use. In various embodiments, the first amount of time is less than the second amount of time and the first amount of water use is less than the second amount of water use. In some embodiments, the first amount of time is 2 seconds and the second amount of time is 6 seconds. In other embodiments, the controller 350 may be configured to operate in a default mode (e.g., normal mode), which may cause the flush assembly 315 and the filling assembly 325 to operate for a third amount of time, which corresponds to a third amount of water use, where the third amount of time is greater than the first amount of time and less than the third amount of time.

Figure 14:
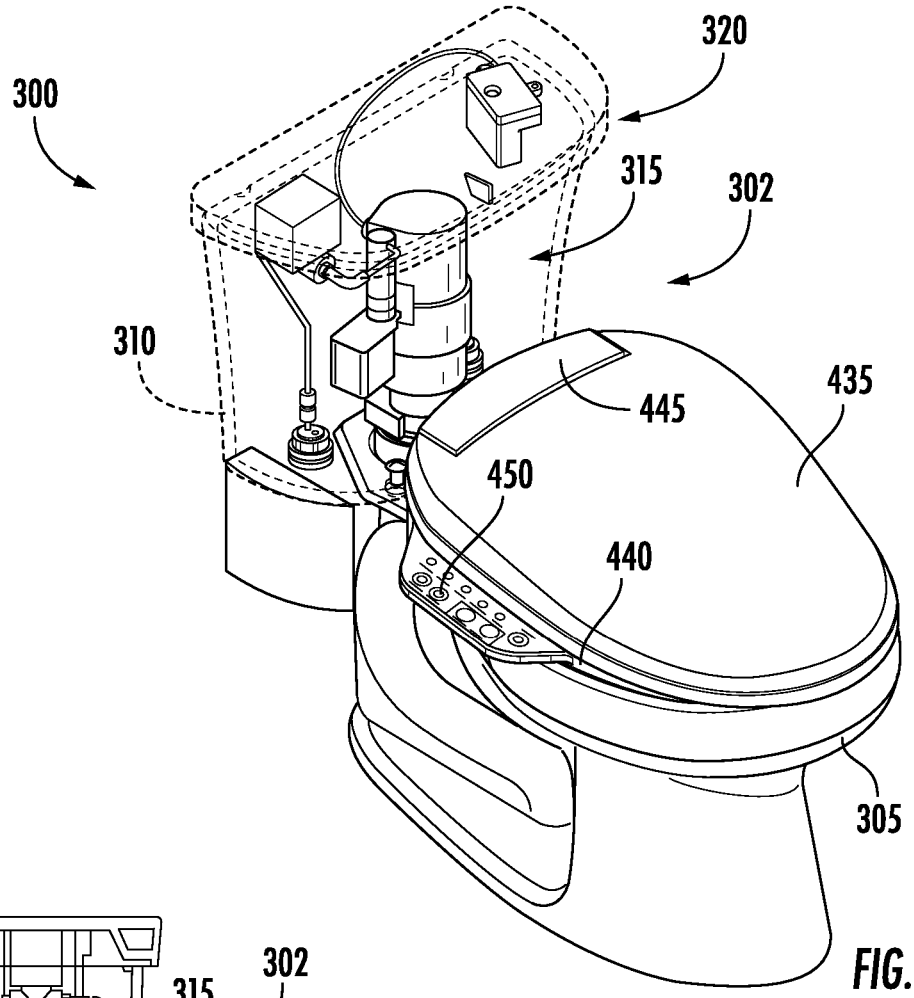
FIG. 14 is perspective view of the toilet system of FIG. 8, according to another exemplary embodiment.
Figure 15:
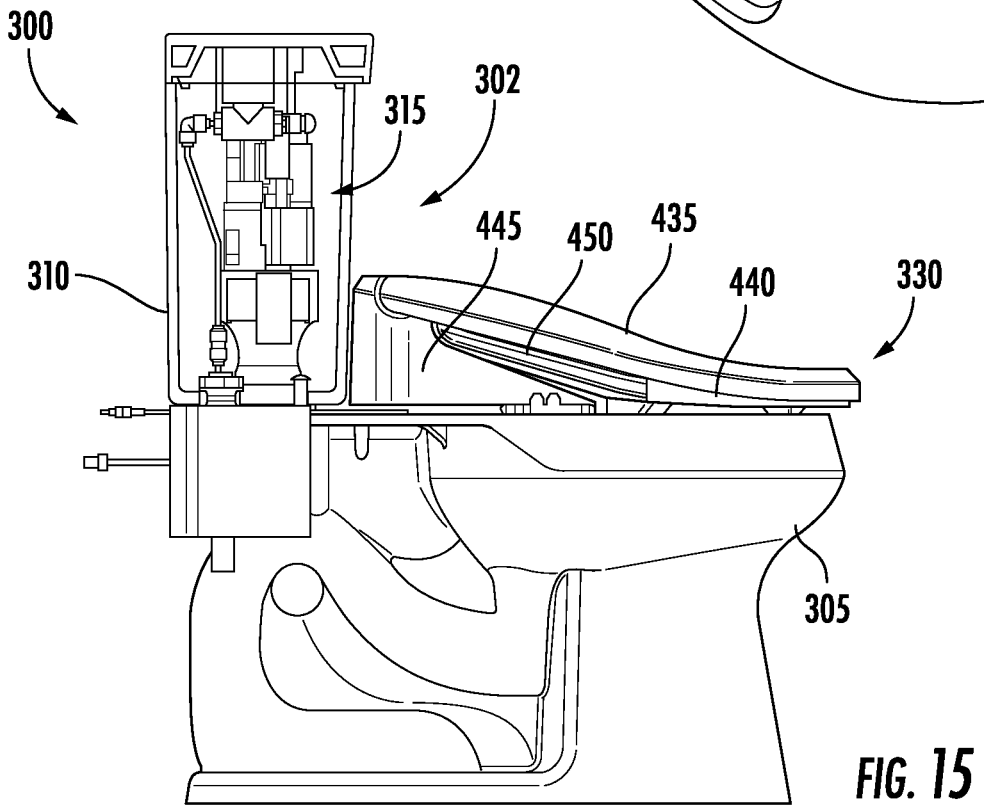
FIG. 15 is a side view of the toilet system of FIG. 14, according to an exemplary embodiment.

In some embodiments, the plumbing assembly 300 may be configured to include one or more user sanitation features to further enhance user experience. For example, as shown in FIGS. 14 and 15, the lid and seat assembly 330 may include a lid 435, which is rotatably coupled to a seat 440. The assembly 330 may further include a bidet unit 445, which may be coupled to a rear portion of the lid 435 and seat 440. The lid and seat assembly 330 may further include a controller 450, where the controller 450 is configured to operate at least one of the bidet unit 445, the flushing assembly 315, the fill assembly 325, or the dual flush valve and re-fill assembly 360. Accordingly, in various embodiments, the controller 450 may configured to initiate or cease operation of the bidet unit 445. In other embodiments, the controller 450 may additionally or alternatively be configured to initiate flushing of the plumbing assembly 300 according to one or more modes. For example, the controller 450 may be configured to operate in a first mode (e.g., liquid mode or light mode) and a second mode (e.g., solid mode or heavy mode). In the first mode, the controller 450 may cause the flush assembly 315 and the filling assembly 325 to operate for a first amount of time, which corresponds to a first amount of water use. In the second mode, the controller 450 may cause the flush assembly 315 and the filling assembly 325 to operate (e.g., causes the valve assembly 370 and/or dual flush valve and re-fill assembly 360 to open) for a second amount of time, which corresponds to a second amount of water use. In various embodiments, the first amount of time is less than the second amount of time and the first amount of water use is less than the second amount of water use. For example, in some embodiments, the first amount of time is 2 seconds and the second amount of time is 6 seconds. In other embodiments, the first and second amount of time may correspond to any span of time, which may be set and/or determined by at least one of the manufacturer, user, or installer of the plumbing assembly 300. In other embodiments, the controller 450 may be configured to operate in a default mode (e.g., normal mode), which may cause the flush assembly 315 and the filling assembly 325 to operate for a third amount of time, which corresponds to a third amount of water use, where the third amount of time is greater than the first amount of time and less than the third amount of time.

In various embodiments, the controller 450 may include a user interface. The user interface may include one or more buttons, knobs, levers, screens, or other features that may be usable by a user of the plumbing system 300 to control operation thereof. In some embodiments, the controller 450 may be communicably coupled to one or more remote devices, such as a user device or remotely located secondary controller. In some embodiments, the controller 450 may be configured to receive one or more inputs for controlling the plumbing assembly 300 from a user device (e.g., mobile device, remote, etc.). For example, in some embodiments, the controller 450 may be configured to receive an input from an application on a mobile device, which causes the plumbing assembly 300 to initiate a flushing operation.

In various embodiments, the lid and seat assembly 330 may be structured to include the sensor 395 (e.g., overflow sensor), which is configured to sense a level of water/fluid within the toilet bowl 305. For example, in some embodiments, the sensor 395 may be disposed within the bidet unit 445 (e.g., such in a bottom portion of the bidet unit 445). In other embodiments, the sensor 395 may be disposed within a portion of the seat 440. For example, in various embodiments, the seat 440 may include a protruding member extending into the toilet bowl 305, where the sensor 395 is disposed on or within the protruding member of the seat 440 such that it may be configured to detect an overflow condition within the toilet bowl 305.

In some embodiments, the plumbing system 300 may be structured to omit the power source 355. Instead, the plumbing system 300 may include one or more power sources (e.g., battery) disposed within the lid and seat assembly 330. For example, in various embodiments, at least one of the bidet unit 445 and/or the controller 450 may include a power source, where the power source is further configured to supply power to the at least one controller 350, the solenoid 345, and/or the dual flush valve and re-fill assembly 360. In various embodiments, the power source 355 may simply be located within the lid and seat assembly 330.

Notwithstanding the embodiments described above in reference to FIGS. 1-15, various modifications and inclusions to those embodiments are contemplated and considered within the scope of the present disclosure.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A plumbing assembly comprising:

a tank;

a bowl in fluid communication with the tank;

a re-fill assembly fluidly coupled to the tank, the re-fill assembly having at least one re-fill assembly valve and being configured to control a flow of water from the tank to the bowl;

at least one controller operably coupled to the re-fill assembly, the at least one controller configured to control the at least one re-fill assembly valve within the re-fill assembly by varying a pressure of the flow of water, wherein varying the pressure of the water comprises adjusting a size of an orifice within the at least one re-fill assembly valve; and a first sensor communicably coupled to the at least one controller, the first sensor being configured to sense a water level within the bowl;

wherein the at least one controller is configured to stop the flow of water responsive to the water level within the bowl satisfying a first threshold.

2. The plumbing assembly of claim 1, further comprising a lid and seat assembly coupled to the bowl.

3. The plumbing assembly of claim 2, wherein the lid and seat assembly includes the at least one controller.

4. The plumbing assembly of claim 2, wherein the lid and seat assembly comprises a bidet.

5. The plumbing assembly of claim 1, wherein the re-fill assembly is configured to operate according to a first mode and a second mode, the first mode corresponding to a first volume of water and the second mode corresponding to a second volume of water.

6. The plumbing assembly of claim 5, wherein the second volume of water is less than the first volume of water.

7. The plumbing assembly of claim 1, further comprising a second sensor disposed within the tank, the second sensor communicably coupled to the at least one controller and configured to sense a water level within the tank.

8. The plumbing assembly of claim 7, wherein the at least one controller is configured to determine a leak condition of the tank responsive to the water level within the tank satisfying a second threshold.

9. The plumbing assembly of claim 7, wherein the at least one controller is configured to determine a leak condition of the tank responsive to a decrease in the water level within the tank over a predetermined period of time.

10. The plumbing assembly of claim 1, wherein the tank comprises a reservoir, the reservoir being structured to receive water from a water supply.

11. The plumbing assembly of claim 1, wherein the bowl comprises a ridge formed within a wall surrounding the bowl, and wherein the first sensor is structured to have shape that is complementary to a shape of the ridge.

12. A method for controlling a water level within a plumbing assembly, the method comprising:

controlling, by a re-fill assembly, a flow of water from a tank to a bowl, the re-fill assembly being coupled to the tank and the bowl being in fluid communication with the tank;

controlling, by at least one controller operably coupled to the re-fill assembly, at least one valve within the re-fill assembly, wherein controlling the at least one valve comprises varying a pressure of the flow of water, wherein varying the pressure of the water comprises adjusting a size of an orifice within the at least one re-fill assembly valve;

sensing, by a first sensor communicably coupled to the at least one controller, a water level within the bowl;

determining, by the at least one controller, the water level within the bowl satisfies a first threshold; and stopping, by the at least one controller, the flow of water to the bowl.

13. The method of claim 12, wherein determining the water level within the bowl satisfies a first threshold comprises determining the water level exceeds the first threshold.

14. The method of claim 12, wherein determining the water level within the bowl satisfies a first threshold comprises determining the water level is increasing over a predetermined period of time.

15. The method of claim 12, wherein controlling the at least one valve within the re-fill assembly comprises adjusting a size of an orifice within the at least one valve.

16. The method of claim 12, wherein controlling the at least one valve within the re-fill assembly comprises sending a signal to a solenoid, the solenoid being operably coupled to the at least one valve, to cause a change in operating status of the at least one valve.

17. The method of claim 12, further comprising filling, by a filling assembly in fluid communication with each of the tank, the bowl, and the re-fill assembly, the tank with water from a water supply.

18. The method of claim 17, further comprising sensing, by a second sensor in communication with the at least one controller, a water level within the tank.

19. The method of claim 18, further comprising determining, by the at least one controller, a leak condition of the tank responsive to a determination that the water level within the tank satisfies a second threshold.

20. The plumbing assembly of claim 1, wherein the at least one re-fill assembly valve comprises a first valve and a second valve, the at least one controller configured to adjust the size of the orifice of the first valve responsive to an opening of the second valve, the first valve comprising a ball valve and the second valve comprising a piston valve.

* * * * *